United States Patent [19]

Galer

[11] Patent Number: 4,667,843

[45] Date of Patent: May 26, 1987

[54] IMPACT-RESISTANT THERMOPLASTIC PAINT CAN AND LID

[76] Inventor: Herbert W. Galer, 24 Woodland Trail, Newnan, Ga. 30263

[21] Appl. No.: 886,613

[22] Filed: Jul. 18, 1986

[51] Int. Cl.[4] ..... B65D 43/06

[52] U.S. Cl. ..... 220/354; 220/307

[58] Field of Search ..... 220/354, 307, 306; 150/55

[56] References Cited

U.S. PATENT DOCUMENTS

| | | | |
|---|---|---|---|
| 4,512,494 | 4/1985 | Von Holdt | 220/354 |
| 4,530,442 | 7/1985 | Vogel, Jr. et al. | 220/354 |
| 4,619,373 | 10/1986 | Galer | 220/354 |

*Primary Examiner*—George T. Hall

*Attorney, Agent, or Firm*—William L. Krayer

[57] ABSTRACT

A thermoplastic container and lid assembly comprising a vertical circular flange on the container top and a complementarily dimensioned channel on the lid for receiving it, the flange being tapered from relatively narrow base to a wide terminus, and the channel having a relatively narrow opening and a wide terminus.

12 Claims, 3 Drawing Figures

IMPACT-RESISTANT THERMOPLASTIC PAINT CAN AND LID

TECHNICAL FIELD

This invention relates to plastic cans such as molded thermoplastic paint cans and in particular to lids, or plugs, herefor which are resistant to loosening by impact. The invention is a design for a molded thermoplastic container lid and container with which it seals. The lid is specially designed to minimize premature opening under stress as when the can is dropped; it also minimizes problems frequently encountered in the initial capping operation.

BACKGROUND ART

Prior to the present invention, a common approach to the problem of design for molded plastic paint can lid assemblies has been to provide an interference fit—that is, typically a relatively large diameter ridge on the top of the container is forced through a relatively small diameter on the lid so that a peripheral ledge on the lid will snap into place on the underside of a smaller diameter on the container. The design for such an interference fit will typically have a vertical dimension immediately above the ledge which is too short to prevent the sliding off of the lid if the container is subjected to impact. Impact from dropping the container, particularly at an angle, and particularly coupled with hydraulic action of a packaged liquid, will distort the ledge in microseconds and result in almost immediate release of the lid from the ledge.

Interference fits are shown, for example, in U.S. Pat. Nos. 4,356,930, 3,977,563, 4,349,119, and 4,512,494.

I am not aware of an approach in the prior art similar to mine, e.g. where a tapered slot and complementary tapered lock rings are employed to make the seal become tighter as the lid is moved upwardly as by the force of impact.

DESCRIPTION OF THE INVENTION

My invention involves the use of two integral locking rings, one on the lid or plug and one on the container top. The locking rings each have a generally U-shaped cross-section and are dimensioned to fit within each other. The interlocking sides of the locking rings, and their complementary receiving channels, are complementarily tapered to provide a snug fit which will become more tenacious as a force acts on them to separate. The generally wedge-shaped cross-section of the receiving channels, having relatively narrow openings and wider termini, each hve angled guiding surfaces to ensure that the complementary parts engage each other during the initial closing operation.

My design most preferably provides relatively deep channels and relatively long vertical dimensions on the locking rings or flanges. Specifically, for a plastic paint can having a volume of one gallon (typically a generally cylindrical shape having a height of about 7.75 inches and a diameter of about 6.75") the channels and locking rings should have contacting surfaces of about 0.15 to about 0.25 inch. The thermoplastic material should have a certain flexibility, i.e. a flexural modulus of about 125,000 to about 225,000. And the outermost flange of the lid may be of a double or U-shaped configuration in itself, to fit within a larger U-shaped channel.

As may be seen below, my invention comprises a thermoplastic lid and container combination comprising a generally U-shaped peripheral channel on the container and a complementary inverted U-shaped peripheral channel on the lid dimensioned so that the outermost peripheral flange of the lid channel will fit snugly into the container channel and the innermost annular flange of the container channel will fit snugly into the lid channel, the flanges and channels further characterized in that the innermost flange on the container channel and the outermost flange on the lid channel are broader at their termini than at their origins.

BEST MODE OF THE INVENTION

My invention most preferably includes angled surfaces on the outermost flange of the container channel and the innermost flange of the lid channel, to guide the interlocking flanges into place during the initial closing operation. It also most preferably includes a double or folded outermost flange on the lid, and a peripheral lip on the lid to permit prying open of the lid. These features are illustrated in the drawings.

DETAILED DESCRIPTION OF THE DRAWINGS

Figure 1:
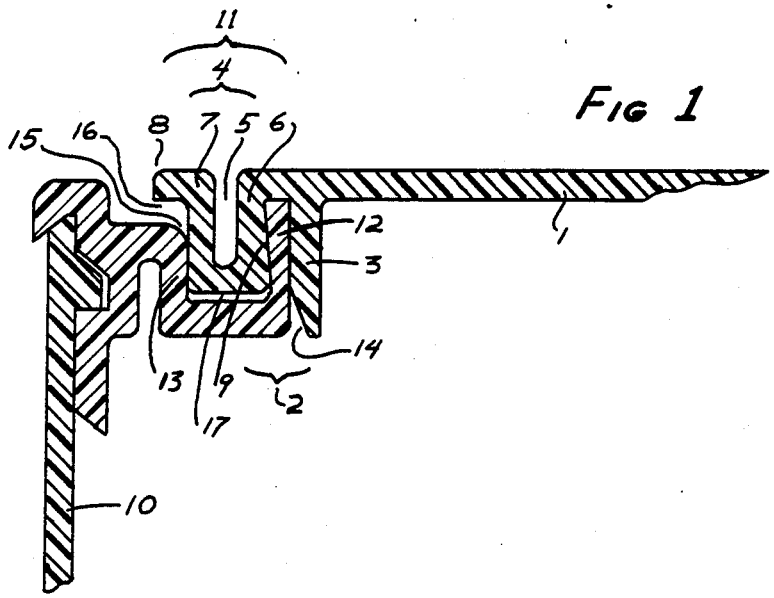

In FIG. 1, the lid 1 is shown having an inverted U-shaped channel 2 defined by an inner flange 3 and an outer flange 4 the outer flange 4 having descending and ascending sides 6 and 7 which may be separated by a space 5. On the extreme outside of the lid is peripheral lip 8. The innermost surface 9 of descending side 6 is angled downwards toward the inside of the container at about 5 degrees thus slightly restricting the entrance to channel 2.

The container 10 has a U-shaped channel 11 formed by an inner flange 12 and an outer flange 13 shown to be somewhat shorter than flange 12. Inner flange 12 is shaped to be broader at its terminus than at its origin; like descending side 6 of the flange 4, the taper of flange 12 is about 5 degrees. Flange 12 and channel 2 are dimensioned to provide a snug fit.

The outside of flange 3 on lid 1 has an angled surface 14, and the inside surface of outside flange 13 is shown with a curved surface 15. These surfaces guide flange 12 and flange 4 into channels 2 and 11 respectively. The vertical distance of actual contact between flanges 3 and 12 may range from about 0.15 to about 0.25 inch or more.

A space 16 may be formed under lip 8 to permit convenient prying of the lid 1; a space 17 may be provided by making flange 4 slightly shorter than channel 11, to permit the accumulation of paint.

It will be seen that, if the container is distorted as by impact anywhere on the container, a tendency of the lid and container to pull apart will result in a tighter fit as the relatively wide parts of flanges 4 and 12 will tend to move into the constricted sections of the channels 11 and 2.

Figure 2:
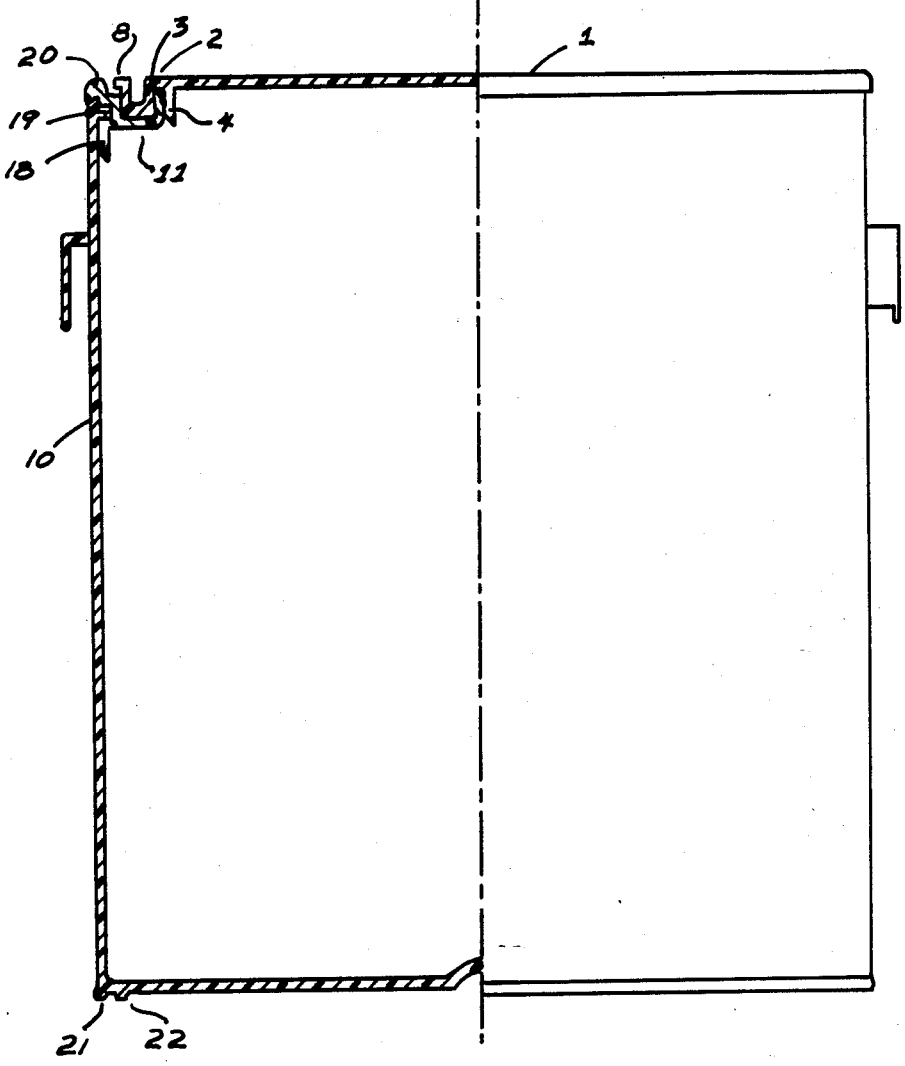

FIG. 2 is a front partial section view of a container and lid of my invention. It will be seen that the plug or lid 1 is generally as depicted in FIG. 1 with an inverted tapered U-shaped channel 2 having flanges 3 and 4 adapted to interlock with a tapered internal flange of U-shaped channel 11. U-shaped channel 11 is seen to be part of a top chime ring 18 on the container 10 which is peripherally mounted on depending circular ring 19.

The container also has an optional peripheral rim 20 at the top of the wall of container 10 (in this case above depending circular ring 19) which rim 20 will nest within concentric peripheral flanges 21 and 22 on the bottom of another container when the containers are stacked. My design thus may combine a configuration providing stackability, and a readily pryable lip 8 with the interlocking tapered flanges and channels as described.

Figure 3:
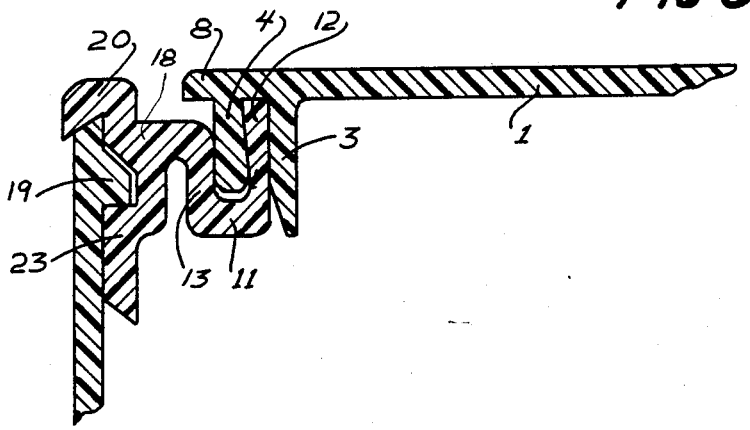

FIG. 3 is a variation of my invention in which the flange 4 is seen to be a solid, single vertical flange fitting into a channel 11 which is not as wide as channel 11 in FIG. 1. Flange 4 does not have a space 5 within it as in FIG. 1. Chanell 11 is, as in FIG. 1, part of a circular chime 18 (FIG. 2) which rests on depending circular ring 19 and is partly supported by leg 23. The construction of this variation of my invention is otherwise similar and has the same advantage of increasing resistance to separation under distortion.

My invention may otherwise practiced and embodied within the scope of the following claims.

I claim:

1. A molded thermoplastic container and lid assembly including a peripheral U-shaped channel on the container and a complementarily-dimensioned inverted U-shaped channel on the lid having an outer flange and an inner flange and adapted to interlock with the U-shaped channel on the container, wherein the channel on the lid is slightly constricted at its opening and the portion of the container channel which interlocks with the lid channel is relatively narrow at its base and relatively wide at its terminus.

2. The container and lid assembly of claim 1 wherein the lid channel includes an angled surface for guiding the interlocking portion of the container channel.

3. The container and lid assembly of claim 1 wherein the outer flange of the lid channel itself has a U-shaped cross-section.

4. The container and lid assembly of claim 1 wherein the inverted U-shaped channel on the lid and the inner flange of the U-shaped channel on the container are complementarily tapered.

5. The container and lid assembly of claim 4 wherein the tapering of the lid channel and the container flange is at an angle of about five degrees.

6. The container and lid assembly of claim 1 wherein the thermoplastic material has a flexural modulus of about 125,000 to about 225,000.

7. The container and lid assembly of claim 1 wherein the outer flange on the lid has an annular channel within it.

8. The container and lid assembly of claim 1 including also concentric peripheral flanges on the bottom of said container and a peripheral rim on the top thereof for nesting between said concentric flanges when one container is stacked on top of another.

9. The container and lid assembly of claim 1 wherein the lid has a peripheral lip spaced apart from said container.

10. The container and lid assembly of claim 1 wherein the U-shaped channel on the container is part of a circular chime held in place partly by an internally-directed dependent ring on said container.

11. A thermoplastic container and lid assembly comprising (a) a cylindrical container having a circular vertical flange which is tapered from a relatively narrow base to a relatively wide terminus and (b) a lid therefor having a channel complementarily dimensioned and tapered for insertion of said vertical flange therein.

12. The container and lid assembly of claim 11 wherein the channel on said lid has an angled surface to guide said vertical flange into it.

* * * * *